US005090592A

United States Patent [19]

Petterson et al.

[11] Patent Number: 5,090,592

[45] Date of Patent: Feb. 25, 1992

[54] NOSE PIECE FOR FOLDED SHEET PRODUCT DISPENSER

[75] Inventors: Tor Petterson, Rancho Palos Verdes; Jean T. McGregor, Covina, both of Calif.

[73] Assignee: James River II, Inc., Oakland, Calif.

[21] Appl. No.: 667,962

[22] Filed: Mar. 12, 1991

[51] Int. Cl.[5] ..... B65H 1/00

[52] U.S. Cl. ..... 221/55; 221/63

[58] Field of Search ..... 221/47, 48, 55, 61, 221/63

[56] References Cited

U.S. PATENT DOCUMENTS

| | | | |
|---|---|---|---|
| 340,355 | 4/1886 | Ramser . | |
| 1,719,690 | 7/1929 | Coons . | |
| 1,874,642 | 8/1932 | Shaffer et al. . | |
| 1,878,399 | 9/1932 | Hope . | |
| 1,898,983 | 2/1933 | Wheeler | 221/48 |
| 2,034,516 | 3/1936 | Hunt et al. . | |
| 2,830,728 | 4/1958 | Krueger et al. | 221/48 |
| 3,071,289 | 1/1963 | Taylor . | |
| 3,071,290 | 1/1963 | Taylor . | |
| 3,203,586 | 8/1965 | Downham . | |
| 3,214,227 | 10/1965 | Filipowicz . | |
| 4,678,099 | 7/1987 | Matsui | 221/48 |
| 4,679,703 | 7/1987 | De Luca . | |

FOREIGN PATENT DOCUMENTS

| | | | |
|---|---|---|---|
| 2538695 | 7/1984 | France | 221/48 |
| 1112680 | 5/1968 | United Kingdom | 221/63 |

*Primary Examiner*—H. Grant Skaggs
*Attorney, Agent, or Firm*—Thomas R. Lampe

[57] ABSTRACT

An apparatus and method for serially dispensing discrete folded sheet products from a stack through an opening in a nose piece. The nose piece includes two pairs of contact elements disposed at different planes whereby the napkin prior to dispensing is subjected to two sequential bending steps with the bends being formed at right angles to one another. During the bending steps a flap terminal end is unsupported by the nose piece over the central portion of the flap terminal end and the bending of the folded sheet product urges the flap terminal end outwardly of the rest of the product to facilitate grasping and removal.

9 Claims, 3 Drawing Sheets

NOSE PIECE FOR FOLDED SHEET PRODUCT DISPENSER

TECHNICAL FIELD

This invention relates to an apparatus and a method for serially dispensing discrete folded sheet products, such as paper napkins, from a stack of the folded sheet products. More particularly, the apparatus includes a nose piece connected to a housing having an interior accommodating the stack of folded sheet products, said nose piece being of a specified character and greatly facilitating manual removal of an end-most folded sheet product from the stack.

BACKGROUND ART

It is well known to dispense paper napkins from dispenser housings through nose pieces connected to the housings and having outlets through which the folded paper products may be grasped and serially removed from the dispenser housing. A search of the prior art located the following patents, all of which are directed to dispensers for paper napkins and the like and incorporate nose pieces or dispenser ends of different types defining openings through which the folded sheet products can be accessed for removal by a consumer: U.S. Pat. No. 1,878,399, issued Sept. 20, 1932 to Hope, U.S. Pat. No. 1,719,690, issued July 2, 1929 to Coons, U.S. Pat. No. 3,203,586, issued Aug. 31, 1965 to Downham, U.S. Pat. No. 4,679,703, issued July 14, 1987 to De Luca, U.S. Pat. No. 3,071,289, issued Jan. 1, 1963 to Taylor, U.S. Pat. No. 3,071,290, issued Jan. 1, 1963 to Taylor, U.S. Pat. No. 2,034,516, issued Mar. 17, 1936 to Hunt et al, U.S. Pat. No. 1,874,642, issued Aug. 30, 1932 to Schaffer et al, U.S. Pat. No. 3,214,227, issued Oct. 26, 1965 to Filipowicz, and U.S. Pat. No. 340,355, issued Apr. 20, 1986 to Ramser.

DISCLOSURE OF INVENTION

In common with prior art nose pieces the nose piece of the present invention defines an opening communicating with the interior of a housing through which folded sheet products are dispensed from the interior in serial fashion. The present nose piece, however, incorporates structure which cooperates in a unique manner to permit withdrawal of a paper napkin or other folded sheet product from and through the nose piece without undue friction being imparted to the dispensed product. Rips or tears in paper napkins or the like often occur when utilizing prior art dispenser constructions, due at least partially to high frictional forces existing during dispensing. Furthermore, the nose piece of the present invention incorporates structure which configures the end-most folded sheet product in a stack in such a manner as to present the terminal end of a product flap for ready access by the consumer.

The dispenser arrangement disclosed and claimed herein is for the purpose of serially dispensing discrete folded sheet products from a stack of the folded sheet products, each of the folded sheet products being of generally rectangular configuration and having a pair of first side edges spaced from each other and substantially parallel. The folded sheet products also have a pair of second side edges, the second side edges being spaced from one another, substantially parallel, and disposed at right angles to the first side edges. Finally, the folded sheet products incorporate a flap having a terminal end positioned between the first side edges and extending between the second side edges.

The dispenser includes a housing having a plurality of side walls defining an interior and a discharge end, the interior accommodating a stack of folded sheet products of the foregoing description and guiding the stack toward the discharge end with the flaps of the folded sheet products presented in the direction of the discharge end.

A nose piece is connected to the housing discharge end and has an opening communicating with the housing interior through which folded sheet products are dispensed from the interior in serial fashion. The nose piece has a front and back, the back facing toward and engageable by the stack in the housing interior. The nose piece includes a pair of first contact elements spaced from one another and defining smooth, inclined first contact surfaces located at the back of the nose piece. The first contact surfaces lead from a first pair of opposed housing side walls and gradually converge toward one another and toward the nose piece front.

The nose piece also includes a pair of second contact elements spaced from one another and defining smooth, inclined second contact surfaces located at the back of the nose piece. The second contact surfaces lead from a second pair of opposed housing side walls and gradually converge toward one another and toward the nose piece front.

The first and second contact elements at least partially define the opening. The first contact elements project toward the housing interior a greater distance than the second contact elements project toward the housing interior.

The first and second contact elements are innerconnected and form a generally continuous, smoothly curved surface about the periphery of the opening leading from the back to the front.

The first contact elements are adapted to engage the end-most folded sheet product of the stack positioned at the discharge end of the housing closely adjacent to the first side edges thereof and bend the end-most folded sheet product about an axis generally parallel to the first contact elements.

The second contact elements are adapted to engage the end-most folded sheet product of the stack positioned at the discharge end of the housing closely adjacent to the second side edges thereof and bend the end-most folded sheet product about an axis generally parallel to the second contact elements.

The method of the present invention comprises the steps of biasing the stack of folded sheet products for movement in a predetermined direction with the flaps of the folded sheet products in the stack facing the predetermined direction.

The folded sheet product at the end of the stack is then brought into engagement with a first pair of spaced, inclined contact surfaces adjacent to the first side edges of the engaging end-most folded sheet product.

Movement of the stack in the predetermined direction is continued while maintaining the end-most folded sheet product in engagement with the first pair of spaced, inclined contact surfaces to form a first bend in the end-most folded sheet product along an axis generally parallel to the terminal end.

During formation of the first bend, the terminal end of the flap is maintained substantially unsupported and out of engagement with the first pair of spaced, inclined contact surfaces.

After the step of bringing the end-most folded sheet product into engagement with the first pair of spaced, inclined contact surfaces, the end-most folded sheet product is brought into engagement with a second pair of spaced, inclined contact surfaces adjacent to the second side edges of the end-most product.

Movement of the stack is continued in the predetermined direction while maintaining the end-most folded sheet product in engagement with the second pair of spaced, inclined contact surfaces to form a second bend in the end-most folded sheet product along an axis generally perpendicular to the first terminal end.

While forming the second bend, opposed extremities of the flap terminal end are maintained in engagement with the second pair of spaced, inclined contact surfaces while leaving the intermediate portion of the flap terminal end essentially unsupported.

A pulling force is exerted on the unsupported intermediate portion of the flap terminal end of the end-most terminal sheet product to separate the end-most folded sheet product from the contact surfaces and from the remainder of the stack.

Other features, advantages, and objects of the present invention will become apparent with reference to the following description and accompanying drawings.

BEST MODE FOR CARRYING OUT THE INVENTION

Figure 1:
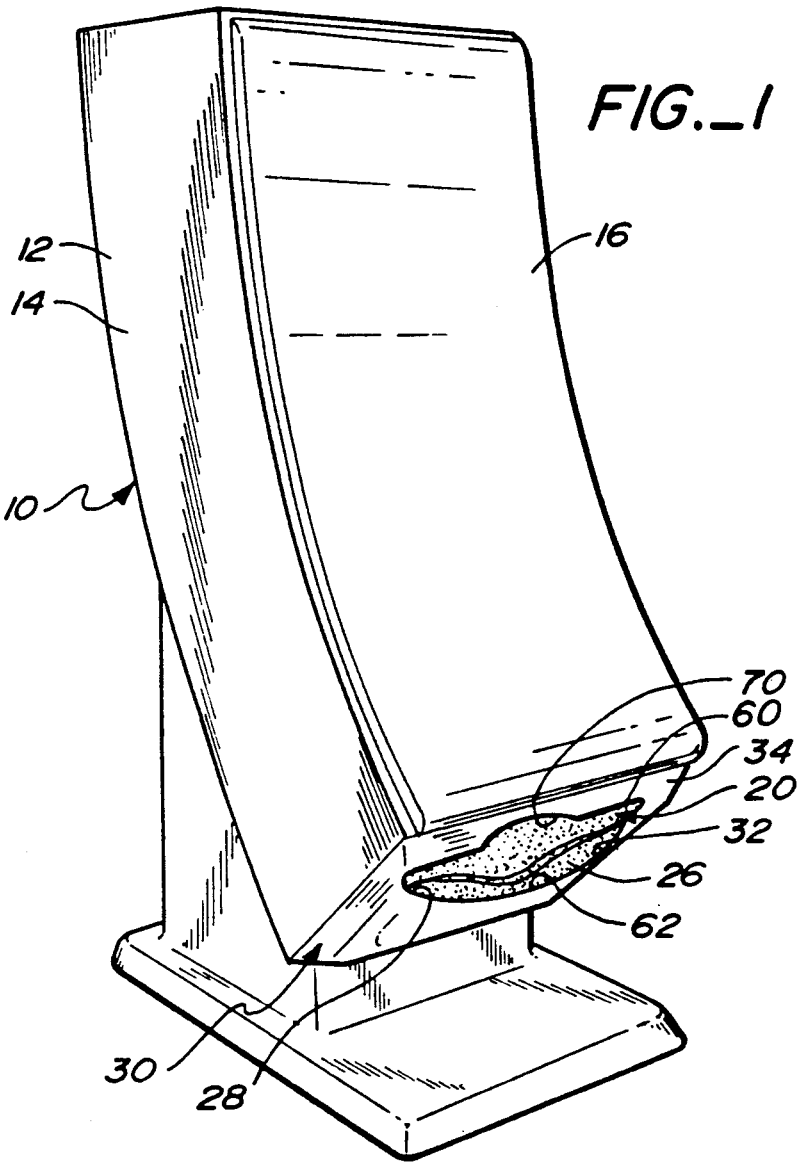
FIG. 1 is a perspective view of a paper napkin dispenser incorporating the nose piece of the present invention.
Figure 5:
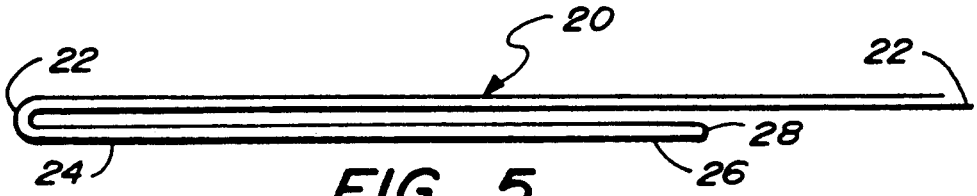
FIG. 5 is a diagrammatic profile view of a folded napkin suitable for dispensing by the dispenser apparatus of FIG. 1.

Referring now to the drawings, FIG. 1 illustrates a dispenser 10 incorporating the teachings of the present invention. Dispenser 10 includes a housing 12 which, as is conventional, includes a plurality of side walls such as side walls 14 and 16. Side wall 16 is, in the embodiment illustrated, in the form of a cover which may be pivoted between open and closed positions, as is conventional, to selectively uncover or cover the interior.

The interior of the dispenser is for the purpose of accommodating a stack of paper napkins 20 and guiding the stack toward the discharge end (lower end of the disclosed embodiment) of the housing.

As may be seen with reference to FIGS. 5–10, the folded napkin 20 is of a generally rectangular configuration and has a pair of first side edges 22 spaced from each other and substantially parallel. Disposed at right angles to the first side edges 22 are second side edges 24, said second side edges being spaced from one another and substantially parallel. The paper napkin 20 also includes a flap 26 having a terminal end 28 positioned between the first side edges 22 and extending between the second side edges.

It will be appreciated that all of the paper napkins 20 in the stack of paper napkins disposed within the housing interior are oriented in the same way. The housing guides the stack toward the discharge end with the flaps 26 of the paper napkins presented in the direction of the discharge end.

A nose piece 30 (FIGS. 1–4) is connected to the housing discharge end and has an opening 32 communicating with the housing interior through which paper napkins are dispensed from the interior in serial fashion.

Nose piece 30 has a front 34 and a back 36, the back facing toward and engageable by the stack of paper napkins 30 in the housing interior. In the illustrated preferred embodiment of the invention, the nose piece 30 is of unitary construction and it may, for example, be comprised of plastic which has been molded or otherwise formed in a conventional manner.

Nose piece 30 includes a pair of first contact elements 40, 42 spaced from one another and defining smooth, inclined first contact surfaces 44, 46 located at the back of the nose piece. The first contact surfaces 44, 46 lead from a first pair of opposed housing side walls, i.e. wall 16 and the opposing wall at the back of the housing, and gradually converge toward one another and toward the nose piece front.

The nose piece also includes a pair of second contact elements 50, 52 which are spaced from one another and define smooth, inclined second contact surfaces 54, 56 located at the back of the nose piece. The second contact surfaces lead from a second pair of opposed housing side walls, namely side wall 14 and its opposed side wall, and gradually converge toward one another and toward the nose piece front. The first and second contact elements thus define the opening 32.

It is important that the first contact elements 40, 42 project toward the housing interior a greater distance than the second contact elements 50, 52 project toward the housing interior. The reason for this will become readily apparent below.

The first and second contact elements are interconnected and form a generally continuous, smoothly curved surface about the periphery of the opening leading from the back to the front.

The nose piece includes a flange 51. When the nose piece is in position relative to the housing, the distal ends of at least some of the housing walls are covered by the flange and at least some of the walls engage nose piece contact elements. See, for example, the relationship between wall 14 and its opposing side wall shown in dash lines in FIG. 4 and the nose piece.

It will be appreciated that the stack of paper napkins within the housing interior is biased toward the nose piece. A mechanical biasing arrangement (not shown), such as a follower plate biased by a spring may be utilized to urge the stack toward the nose piece.

Figure 6:
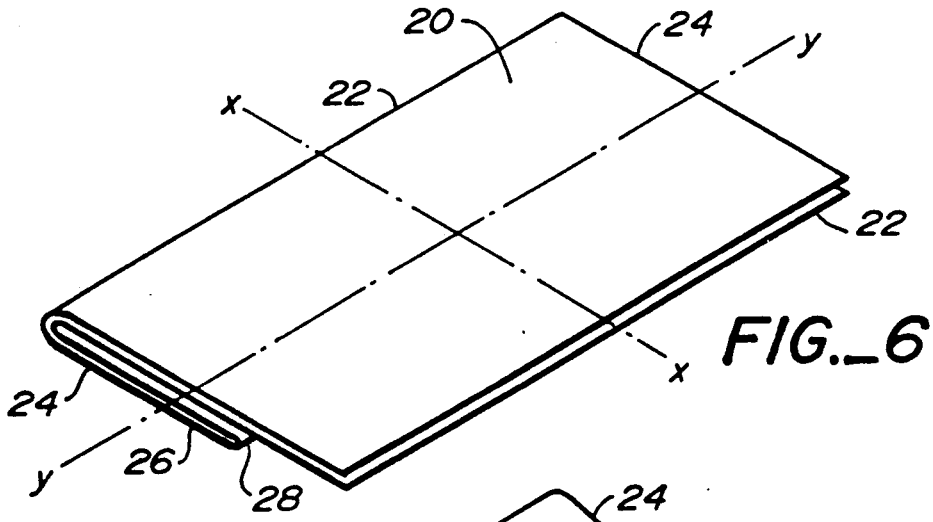
FIG. 6 is a perspective view of the napkin and illustrating the napkin in its normal flat condition.
Figure 7:
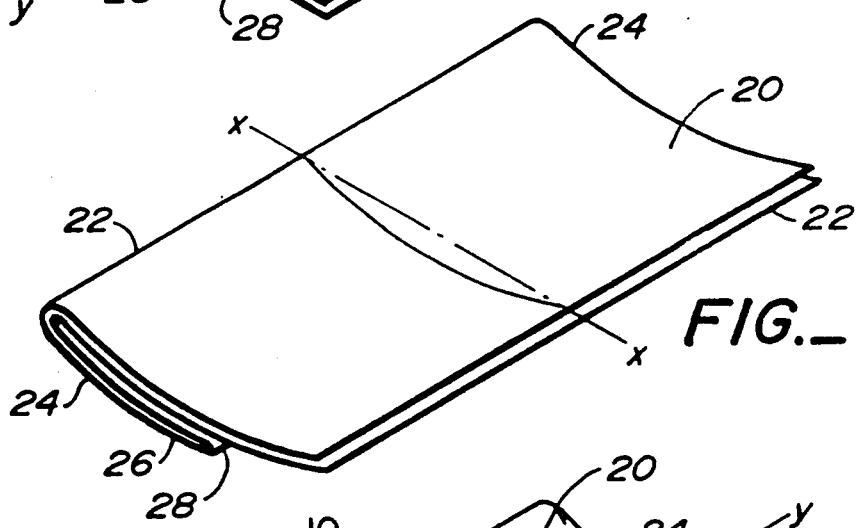
FIG. 7 is a perspective view of the napkin illustrating the configuration assumed thereby when it engages a pair of first contact elements incorporated in the nose piece.

The first contact elements 40, 42 are engageable by the end-most paper napkin of the stack positioned at the discharge end of the housing closely adjacent to the first side edges thereof. Continued movement of the stack after initial engagement with the first contact elements will cause the first side edges 22 of the end-most paper napkin to slide along first contact surfaces 44, 46 and create a bend in the end-most paper napkin about an axis generally parallel to the first contact elements. FIGS. 6 and 7 denote this axis as axis Y—Y and FIG. 7 illustrates diagrammatically the resultant bend after engagement with first contact elements 40, 42 take place and the sliding action along first contact surfaces 44, 46 has occurred. During this operation, the end 28 of the flap 26 is unsupported and out of engagement with the first contact elements. The terminal end of the flap is thus free to move away from remainder of the paper napkin to some degree.

Figure 3:
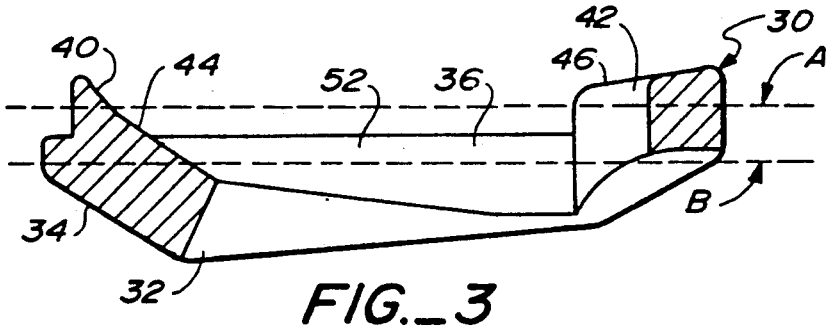
FIG. 3 is a cross-sectional view taken along the line 3—3 of FIG. 2.
Figure 4:
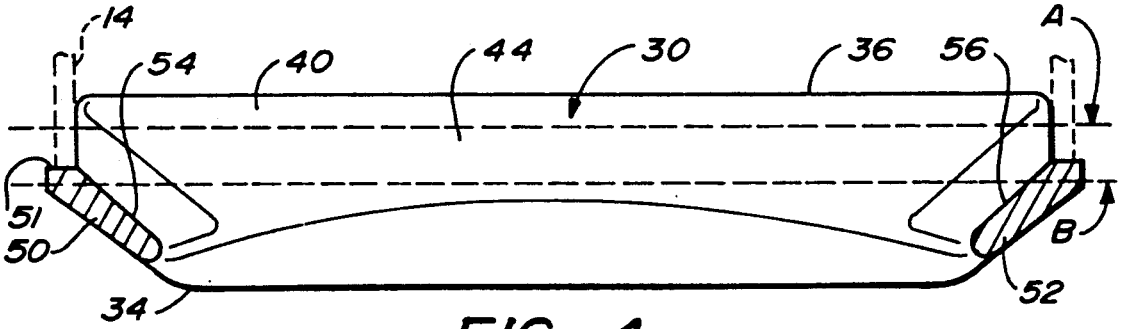
FIG. 4 is a cross-sectional view taken along the line 4—4 of FIG. 2.

With reference to FIGS. 3 and 4 of the drawing, initial engagement between the first contact elements 40, 42 and the end-most paper napkin occurs generally along a plane designated by the letter A.

The end-most paper napkin now engages the second contact elements 50, 52 closely adjacent to the second side edges 24 of the end-most napkin. This serves to bend the end-most paper napkin 20 about axis X—X which is generally parallel to the second contact elements 50, 52. Engagement with the pair of second contact elements takes place generally at the level of plane B shown in FIGS. 3 and 4 relative to the nose piece.

Second contact elements 50, 52 are so configured and relatively positioned as to engage only the opposed extremities of the terminal end 28 of flap 26. The flap terminal end otherwise does not engage the nose piece, being in registry with an area of maximum opening width 60 where the opening flares out from a semi-circular shaped opening area 62 immediately adjacent thereto.

Figure 10:
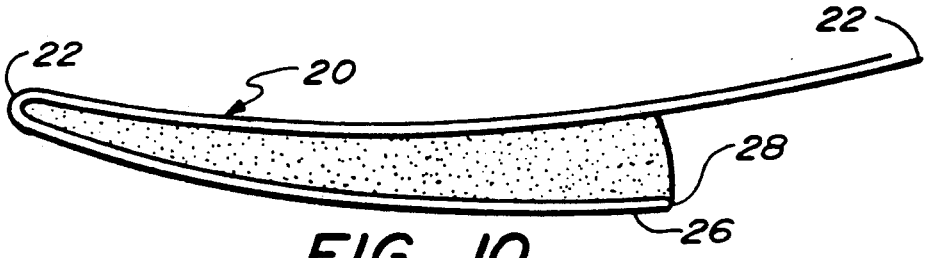
FIG. 10 is a cross-sectional view taken along line 10—10 in FIGS. 8 and 9 illustrating the displacement of the central or intermediate portion of the flap terminal end of the paper napkin relative to the remainder of the napkin when in dispensing position relative to the nose piece.
Figure 2:
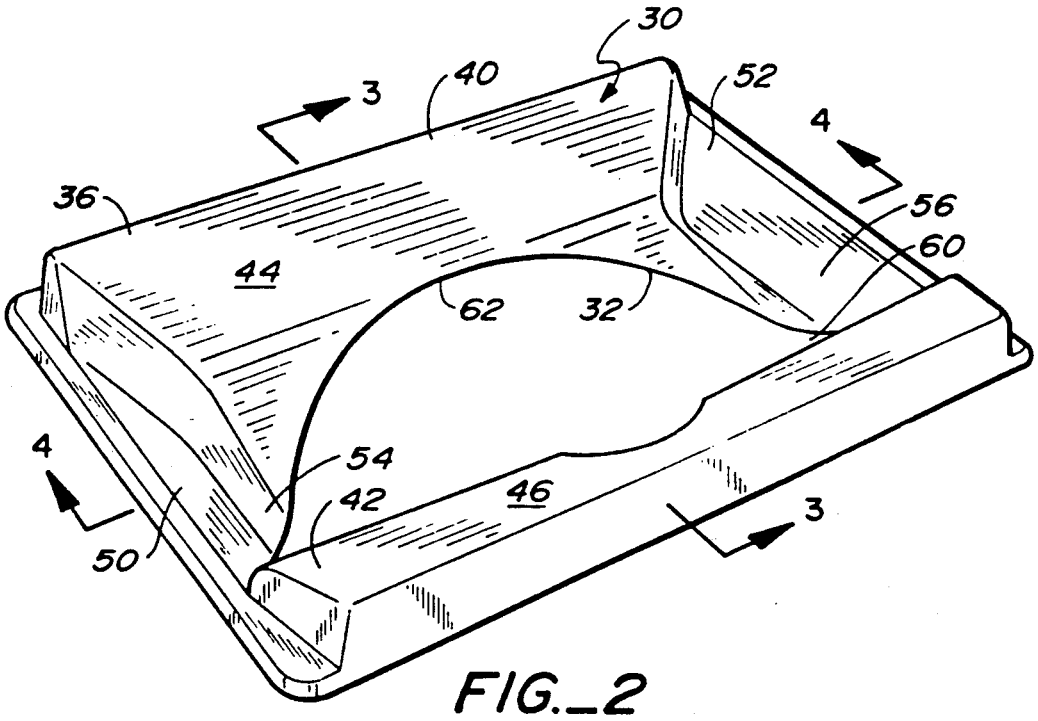
FIG. 2 is a perspective view of the back of the nose piece.
Figure 8:
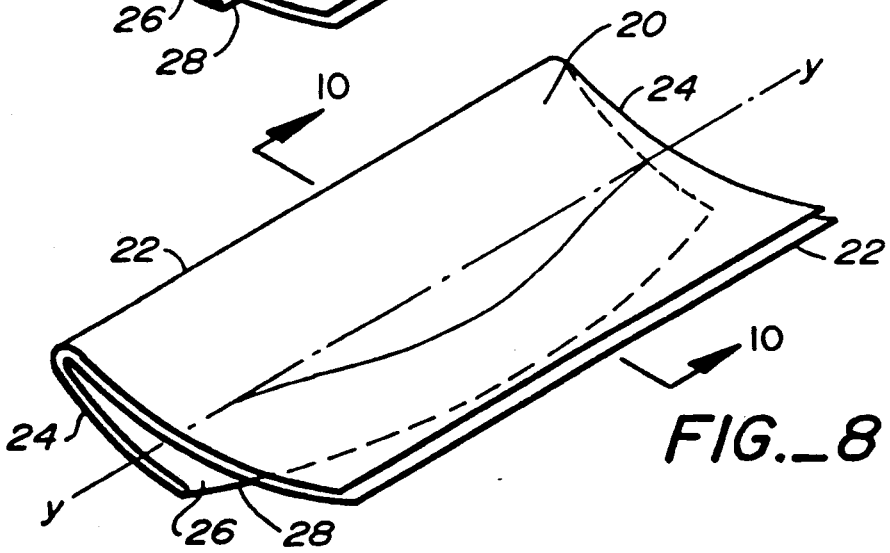
FIG. 8 is a perspective view of the napkin and illustrating the configuration assumed thereby after further travel into the nose piece and engagement with a pair of second contact elements comprising part of the nose piece.
Figure 9:
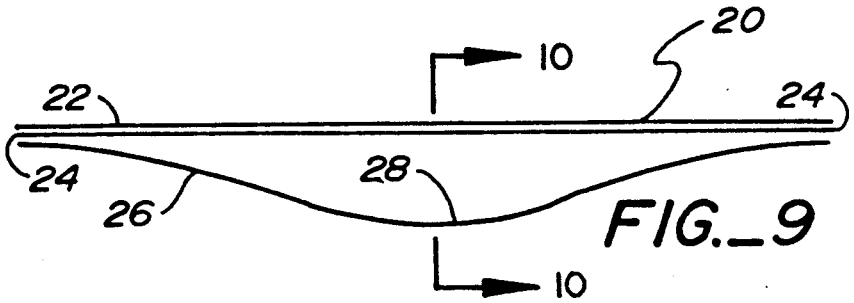
FIG. 9 is a diagrammatic, front elevation view of the paper napkin illustrating the configuration assumed thereby when ready for dispensing from the nose piece.

The result of the compound bending of the end-most paper napkin 20 and the sliding of the second side edges 24 of the napkin on second contact surfaces 54, 56 while the flap terminal end is supported only at the opposed extremities thereof is to force the intermediate portion of the flap terminal end outwardly of the rest of the napkin in the manner illustrated in somewhat diagrammatic fashion in FIGS. 8-10. A consumer can now readily grasp the flap terminal end and withdraw the paper napkin disposed at the end of the stack outwardly through opening 32. The smoothly curved surfaces defining the opening greatly facilitate such removal by reducing frictional forces between the nose piece and the removed napkin. First contact element 42 has an area of reduced thickness 70 at a location spaced from the flap terminal end to further facilitate manual grasping of the flap terminal end.

It may be seen from the above that the method of serially dispensing paper napkins from a stack according to the teachings of the present invention includes the step of biasing the stack for movement in a predetermined direction with the flaps of the folded sheet products in the stack facing the predetermined direction.

The paper napkin at the end of the stack is then brought into engagement with a first pair of spaced, inclined contact surfaces adjacent to the first side edges of the engaging end-most paper napkin.

Movement of the stack is continued in the predetermined direction while maintaining the end-most paper napkin in engagement with the first pair of spaced, inclined contact surfaces to form a first bend in the end-most folded paper napkin along an axis generally parallel to the terminal end.

During formation of the first bend, the flap terminal end is maintained substantially unsupported and out of engagement with the first pair of spaced, inclined contact surfaces.

After the step of bringing the end-most paper napkin into engagement with a first pair of spaced, inclined contact surfaces, the end-most paper napkin is brought into engagement with a second pair of spaced, inclined contact surfaces adjacent to the second side edges of the end-most napkin.

Movement of the stack is continued in the predetermined direction while maintaining the end-most paper napkin in engagement with the second pair of spaced, inclined contact surfaces to form a second bend in the end-most napkin along an axis generally perpendicular to the first terminal end.

While forming the second bend, the opposed extremities of the flap terminal end are maintained in engagement with the second pair of spaced, inclined contact surfaces while leaving the intermediate portion of the flap terminal end essentially unsupported.

Finally, a pulling force is exerted on the unsupported immediate portion of the flap terminal end of the end-most napkin to separate the napkin from the contact surfaces and from the remainder of the stack.

We claim:

1. In a dispenser for serially dispensing discrete folded sheet products from a stack of said folded sheet products, each of said folded sheet products being of generally rectangular configuration and having a pair of first side edges spaced from each other and substantially parallel, a pair of second side edges, said second side edges being spaced from one another, substantially parallel, and disposed at right angles to said first side edges, and a flap having a terminal end positioned between said first side edges and extending between said second side edges, the combination comprising:

a housing having a plurality of side walls defining an interior and a discharge end, said interior accommodating a stack of folded sheet products and guiding said stack toward said discharge end with the flaps of the folded sheet products presented in the direction of said discharge end; and a nose piece connected to said housing discharge end and having an opening communicating with said housing interior through which folded sheet products are dispensed from said interior in serial fashion, said nose piece having a front and a back, said back facing toward and engageable by the stack in said housing interior, said nose piece including a pair of elongated first contact elements spaced from one another, substantially parallel to one another, and defining smooth, inclined first contact surfaces located at the back of said nose piece, said first contact surfaces leading from a first pair of opposed housing side walls and gradually converging toward one another and toward the nose piece front, and a pair of elongated second contact elements spaced from one another, substantially parallel to one another, and defining smooth, inclined second contact surfaces located at the back of said nose piece, said second contact surfaces leading from a second pair of opposed housing side walls and gradually converging toward one another and toward the nose piece front, said first and second contact elements at least partially defining said opening, and said first contact elements projecting toward the housing interior a greater distance than the second contact elements project toward the housing interior, said first contact elements being substantially straight and of sufficient length to engage the end-most folded sheet product of the stack positioned at the discharge end of the housing closely adjacent to the first side edges along substantially the full length of said first side edges along a first plane and bend said end-most folded sheet product about a first axis generally parallel to said first contact elements to shorten the distance between said first side edges, said second contact elements being substantially straight and of sufficient length to engage the end-most folded sheet product of the stack positioned at the discharge end of the housing closely adjacent to the second side edges along substantially the full length of said second side edges along a second plane spaced from said first plane and so positioned relative to said first contact elements as to bend said end-most folded sheet product about a second axis generally parallel to said second contact elements after bending of the end-most folded sheet product about said first axis to shorten the distance between said second side edges and force an intermediate portion of flap terminal end thereof outwardly of the rest of the said end-most folded sheet product.

2. The combination according to claim 1 wherein said first and second contact elements are interconnected and form a generally continuous, smoothly curved surface about the periphery of said opening leading from said back to said front.

3. The combination according to claim 1 wherein said second contact elements are so configured and relatively positioned as to engage only the opposed extremities of the flap terminal end of said end-most folded sheet product, said flap terminal end otherwise not engaging said nose piece whereby said flap terminal end is separated substantially the full length thereof between said extremities from the remainder of said end-most folded sheet product, and is exposed and readily accessible from the front of said nose piece through said opening.

4. The combination according to claim 3 wherein said opening flares outwardly to define an area of maximum opening width in registry with the flap terminal end of said end-most folded sheet product.

5. The combination according to claim 4 wherein one of said first contact elements has an area of reduced thickness at a location spaced from the flap terminal end of said end-most folded sheet product to further facilitate manual grasping of said flap terminal end.

6. The combination according to claim 4 wherein one of said first contact elements and said second contact elements define a substantially semi-circular shaped opening area adjacent said area of maximum opening width.

7. The combination according to claim 1 wherein said nose piece is of unitary construction.

8. The combination according to claim 1 wherein said nose piece includes a flange projecting outwardly from at least some of said contact elements, said contact elements at least partially positioned in said housing interior in engagement with walls of said housing, and said flange covering distal ends of said housing walls.

9. A method for serially dispensing folded sheet products from a stack of said folded sheet products, each of said folded sheet products being of generally rectangular configuration and having a pair of first side edges spaced from each other and substantially parallel, a pair of second side edges spaced from each other, substantially parallel, and disposed at right angles to said first side edges, and a flap having a terminal end positioned between said first side edges and extending between said second side edges, said method comprising the steps of:

biasing said stack for movement in a predetermined direction with the flaps of the folded sheet products in said stack facing said predetermined direction;

bringing the folded sheet product at the end of said stack into engagement with a first pair of spaced, elongated, substantially parallel, inclined contact surfaces adjacent to the first side edges of the engaging end-most folded sheet product along substantially the full length of said first side edges along a first plane;

continuing movement of said stack in said predetermined direction while maintaining the end-most folded sheet product in engagement with the first pair of spaced, elongated, substantially parallel inclined contact surfaces to form a first bend in said end-most folded sheet product along a first axis generally parallel to said terminal end to shorten the distance between said first side edges;

during formation of said first bend, maintaining the terminal end of said flap substantially unsupported and out of engagement with said first pair of spaced, inclined contact surfaces;

after the step of bringing the end-most folded sheet product into engagement with the first pair of spaced, inclined contact surfaces at said first plane and initiating the first bend, bringing the end-most folded sheet product into engagement with a second pair of spaced, elongated, substantially parallel, inclined contact surfaces adjacent to the second side edges of the end-most product along substantially the full length of said second side edges along a second plane spaced from said first plane;

after initiating the first bend, continuing movement of said stack in said predetermined direction while maintaining the end-most folded sheet product in engagement with the second pair of spaced, elongated, substantially parallel, inclined contact surfaces along substantially the full length of said second side edges to form a second bend in said end-most folded sheet product along a second axis generally perpendicular to said first terminal end to shorten the distance between the second side edges and force the intermediate portion of the flap terminal end away from the rest of the end-most folded sheet;

while forming said second bend, maintaining opposed extremities of the flap terminal end in engagement with said second pair of spaced, elongated, substantially parallel inclined contact surfaces while leaving the intermediate portion of the flap terminal end essentially unsupported and positioned away from the rest of the end-most folded sheet product; and exerting a pulling force on the unsupported intermediate portion of the flap terminal end of the end-most folded sheet product to separate the end-most folded sheet product from the contact surfaces and from the remainder of the stack.

* * * * *